US010435843B2

(12) United States Patent
Lu et al.

(10) Patent No.: US 10,435,843 B2
(45) **Date of Patent: *Oct. 8, 2019**

(54) METHOD FOR PRODUCING PAPER

(71) Applicant: Kemira Oyj, Helsinki (FI)

(72) Inventors: Chen Lu, Marietta, GA (US); Junhua Chen, Mableton, GA (US); Clay Campbell, Easton, MD (US); Scott Rosencrance, Douglasville, GA (US); Jenna Sue Rabideau, Rydal, GA (US)

(73) Assignee: KEMIRA OYJ, Helinski (FI)

( * ) Notice: Subject to any disclaimer, the term of this patent is extended or adjusted under 35 U.S.C. 154(b) by 33 days.

This patent is subject to a terminal disclaimer.

(21) Appl. No.: 15/649,852

(22) Filed: Jul. 14, 2017

(65) Prior Publication Data

US 2017/0314204 A1 Nov. 2, 2017

Related U.S. Application Data

(63) Continuation-in-part of application No. 15/543,633, filed as application No. PCT/US2016/018033 on Feb. 16, 2016.

(51) Int. Cl.

| | |
|---|---|
| ***D21H 21/18*** | (2006.01) |
| ***D21H 17/37*** | (2006.01) |
| ***D21H 17/56*** | (2006.01) |
| ***D21H 17/64*** | (2006.01) |
| ***D21H 19/12*** | (2006.01) |
| ***D21C 9/00*** | (2006.01) |
| ***D21H 17/06*** | (2006.01) |
| ***D21H 17/39*** | (2006.01) |
| ***D21H 17/65*** | (2006.01) |

(52) U.S. Cl.

CPC ..... *D21H 21/18* (2013.01); *D21C 9/002* (2013.01); *D21H 17/06* (2013.01); *D21H 17/375* (2013.01); *D21H 17/39* (2013.01); *D21H 17/56* (2013.01); *D21H 17/64* (2013.01); *D21H 17/65* (2013.01); *D21H 19/12* (2013.01)

(58) Field of Classification Search

CPC ..... D21H 17/375; D21H 17/64; D21H 21/20; D21H 17/56; D21H 21/18; D21H 23/22; D21H 17/06; D21H 17/33; D21H 17/36; D21H 17/65; D21H 23/10; D21H 23/16; D21H 23/26; D21H 23/66

See application file for complete search history.

(56) References Cited

U.S. PATENT DOCUMENTS

| | | | | |
|---|---|---|---|---|
| 1,808,070 A | | 6/1931 | Rafton | |
| 2,014,026 A | | 9/1935 | Nebel | |
| 2,325,302 A | * | 7/1943 | Britt | D21H 17/50 162/166 |
| 3,332,835 A | * | 7/1967 | Smith | C08F 28/00 162/158 |
| 3,372,085 A | * | 3/1968 | Westfall | C08G 18/0814 162/164.3 |
| 3,556,933 A | | 1/1971 | Williams et al. | |
| 3,728,216 A | | 4/1973 | Bankert | |
| RE30,259 E | | 4/1980 | Moriya et al. | |
| 5,510,004 A | * | 4/1996 | Allen | C08F 26/00 162/135 |
| 5,567,798 A | * | 10/1996 | Dulany | C08G 73/0286 162/164.6 |
| 5,690,790 A | * | 11/1997 | Headlam | D21H 21/20 162/164.7 |
| 5,824,190 A | * | 10/1998 | Guerro | B41M 5/5254 162/135 |
| 6,197,919 B1 | * | 3/2001 | Crisp | C08F 220/04 528/230 |
| 6,368,456 B1 | * | 4/2002 | Cimecioglu | C08B 15/02 162/146 |
| 6,824,648 B2 | | 11/2004 | Edwards et al. | |
| 9,121,137 B2 | | 9/2015 | Viazmensky et al. | |
| 2001/0034406 A1 | * | 10/2001 | Yamamoto | C08G 73/0286 524/845 |
| 2005/0161181 A1 | * | 7/2005 | St. John | D21H 17/55 162/158 |
| 2008/0082198 A1 | * | 4/2008 | Gray | D21F 3/00 700/128 |
| 2009/0165978 A1 | | 7/2009 | Hagiopol et al. | |
| 2011/0146925 A1 | * | 6/2011 | Bode | C08L 33/26 162/164.1 |
| 2013/0081771 A1 | * | 4/2013 | Luo | D21H 17/55 162/164.6 |
| 2013/0126113 A1 | | 5/2013 | Tan et al. | |
| 2013/0160959 A1 | * | 6/2013 | Rosencrance | D21H 17/56 162/164.6 |
| 2013/0192782 A1 | * | 8/2013 | Benz | D21H 17/16 162/164.6 |
| 2014/0182799 A1 | * | 7/2014 | Castro | D21H 23/56 162/164.6 |
| 2014/0262091 A1 | * | 9/2014 | Lu | D21H 17/47 162/164.6 |

(Continued)

FOREIGN PATENT DOCUMENTS

| | | |
|---|---|---|
| EP | 1 456 472 B1 | 11/2008 |
| EP | 1 518 025 B1 | 12/2009 |

(Continued)

OTHER PUBLICATIONS

Eder José Siqueira in "Polyamidoamine epichlorohydrin-based papers : mechanisms of wet strength development and paper repulping," HaL, pp. 1-286 (Year: 2014).*

(Continued)

*Primary Examiner* — Jose A Fortuna

(74) *Attorney, Agent, or Firm* — Robert P. Michal, Esq.; Carter, DeLuca & Farrell LLP

(57) ABSTRACT

A method for manufacturing paper is disclosed. A pulp slurry is produced, a paper sheet is formed from the slurry, an aldehyde functionalized polymer or polymers in combination with at least one additional strength additive is added to the slurry before and/or after sheet formation, and a water soluble acid is added on the paper sheet.

34 Claims, No Drawings

(56) References Cited

U.S. PATENT DOCUMENTS

| | | | | |
|---|---|---|---|---|
| 2014/0284011 | A1* | 9/2014 | Krapsch | D21C 5/02 162/168.3 |
| 2015/0144282 | A1* | 5/2015 | Lu | D21H 17/43 162/164.5 |
| 2015/0176206 | A1* | 6/2015 | Chen | D21H 27/002 162/168.3 |
| 2017/0037574 | A1* | 2/2017 | Grimm | C08F 220/56 |
| 2017/0314204 | A1* | 11/2017 | Lu | D21H 21/18 |
| 2018/0051416 | A1* | 2/2018 | Lu | D21H 23/22 |
| 2018/0105987 | A1* | 4/2018 | Lu | D21H 17/07 |

FOREIGN PATENT DOCUMENTS

| | | | | |
|---|---|---|---|---|
| EP | 2 358 941 | B1 | 10/2014 | |
| EP | 2 438 237 | B1 | 3/2015 | |
| GB | 656907 | A * | 9/1951 | D21H 17/51 |
| WO | WO-92/05311 | A1 | 4/1992 | |
| WO | WO-00/43428 | A1 | 7/2000 | |
| WO | WO-2008/157321 | A2 | 12/2008 | |
| WO | WO-2013/095952 | A1 | 6/2013 | |
| WO | WO-2013095952 | A1 * | 6/2013 | D21H 17/56 |
| WO | WO-2013192082 | A1 * | 12/2013 | D21H 27/002 |
| WO | WO-2015/038901 | A1 | 3/2015 | |
| WO | WO-2015/075318 | A1 | 5/2015 | |
| WO | WO-2017106310 | A1 * | 6/2017 | C08F 230/06 |
| WO | WO-2017142511 | A1 * | 8/2017 | D21H 23/22 |
| WO | WO-2017151084 | A1 * | 9/2017 | D21H 17/07 |
| WO | WO-2018122446 | A1 * | 7/2018 | C08F 8/28 |

OTHER PUBLICATIONS

International Search Report issued by the European Patent Office acting as the International Searching Authority in relation to International Patent Application No. PCT/US2016/018033 dated Nov. 7, 2016 (5 pages).

Written Opinion of the International Searching Authority issued by the European Patent Office acting as the International Searching Authority in relation to International Patent Application No. PCT/US2016/018033 dated Nov. 7, 2016 (6 pages).

* cited by examiner

METHOD FOR PRODUCING PAPER

CROSS-REFERENCE TO RELATED APPLICATIONS

This application is a continuation in part of U.S. patent application Ser. No. 15/543,633, filed Jul. 14, 2017 which, in turn, is a National Phase Entry under 35 USC § 371 of PCT Patent Application Serial No. PCT/US20161018033 filed Feb. 16, 2016, the disclosures of each of which are expressly incorporated herein by reference in their entirety.

FIELD OF THE INVENTION

The present invention relates to a method for producing paper and a paper product produced by the method.

BACKGROUND

Paper is sheet material containing interconnected small, discrete fibers. The fibers are usually formed into a sheet on a fine screen from a dilute water suspension or slurry. Paper typically is made from cellulose fibers, although occasionally synthetic fibers may be applied. Paper products made from untreated cellulose fibers lose their strength rapidly when they become wet, i.e., they have very low wet strength. Wet strength resin can be added to paper to produce stronger paper products. The types of wet strength resins that can be applied to paper may either be of "permanent" or "temporary" type, which are defined, in part, by how long the paper retains its wet strength after immersion in water.

Wet strength of paper is defined to be a measure of how well the fiber web holds together upon a force of rupture when in contact with water. Various techniques, such as refining of the pulp and wet pressing on the paper machine, can be used to reduce the strength loss of the paper upon wetting. The wet strength resins may improve the dry strength of the paper, as well. Wet strength improves the tensile properties of the paper both in wet and dry state by crosslinking the cellulose fibers with covalent bonds that do not break upon wetting. Wet strength is routinely expressed as the ratio of wet to dry tensile breaking force. Aldehyde functionalized polymers, such as glyoxylated polyacrylamide (GPAM), are widely used to increase wet strength.

During the papermaking process, aldehyde functionalized polymers, such as GPAM, are often added to the pulp suspension before paper sheet formation. Upon drying of the treated paper sheet the aldehyde functionalized polymer is believed to form covalent bonds with cellulose to increase paper dry strength and wet strength. Since the formation of covalent bond between the aldehyde functionalized polymer and cellulose is reversible in water, paper wet strength will decrease over time in water. As a result, the aldehyde functionalized polymers are also used as a temporary wet strength agent for tissue papers.

The strength performance of aldehyde functionalized polymers, such as GPAM, is known to be adversely affected by relatively high pH and high levels of alkalinity. In the absence of alkalinity, the aldehyde functionalized polymers are highly effective at acidic and neutral conditions. However, increasing pH of the aqueous solution to a value above 7 will result in significant strength loss. With alkalinity level of 50 ppm ($CaCO_3$) or higher, the strength performance of aldehyde functionalized polymers, such as GPAM, is impaired even at neutral pH conditions.

The negative effect of pH and alkalinity limits the application of the aldehyde functionalized polymer in many paper grades.

Precipitated calcium carbonate (PCC) filler is often added to printing/writing paper for various benefits, such as for decreasing the cost and increasing opacity. The disadvantage is that carbonate ions from PCC dissolve in water, leading to high alkalinity and high pH of the pulp.

In addition, the application of the aldehyde functionalized polymer is also disadvantageous in many paper products produced using recycled pulps. This is because recycled paper often contains PCC and ground calcium carbonate (GCC). GCC originates typically from paper coating materials. Both PCC and GCC are re-introduced into the papermaking process and they both increase alkalinity of the system.

Papermakers often add strong acids to the pulp slurry during the papermaking process to enhance the performance of the aldehyde functionalized polymer. However, large quantity of acid is needed to lower the pH under high alkalinity conditions. Furthermore, lowering the pH of the papermaking water causes other issues, such as corrosion and compromise of process chemicals. Adding acid directly into pulp slurry results often in immediate precipitation or deposition of certain dissolved and suspended chemicals and particles. The handling of corrosive strong acids is also a safety concern for paper machine operators.

Therefore, there is a need to solve the problem for using aldehyde functionalized polymer effectively alone or together with other strength chemicals during papermaking, especially in those cases where the pH and/or the alkalinity of the pulp slurry is high.

Moreover, the aldehyde functionalized polymer is often applied on tissue paper grades to provide temporary wet strength. Upon drying of the treated paper sheet, aldehyde functionalized polymer is believed to form acetal covalent bonds with paper cellulose to increase paper initial wet strength. As the acetal bond formation is reversible in water it will decay over time. Consequently, aldehyde functionalized polymer products are often chosen over commercial permanent wet strength resins to improve paper repulping efficiency and also flushability in the sewage system.

As already discussed, GPAM performance is highly dependent on the wet end pH and alkalinity. Lowering pH and alkalinity facilitates acetal bond formation, leading to increased initial wet strength. Consequently, papermakers lower wet end pH to increase GPAM efficiency. The existing GPAM application methods may result in significant residual wet strength even when paper is in contact with water for an extended period of time i.e. permanent wet strength is obtained, especially under acidic wet end pH conditions. It would therefore be highly desirable to increase the wet tensile decay rate, as well, while still maintaining high initial wet strength performance.

SUMMARY OF THE INVENTION

One object of the present invention is to provide a solution to the problems encountered in the prior art.

Specifically, the present invention aims at solving the problem of improving the paper strength performance during a paper manufacturing process.

In particular, one object of the present invention is to provide a method for improving the strength performance of the aldehyde functionalized polymer which is used as paper strength resin in the papermaking process.

A further object of the invention is to provide a method for improving the aldehyde functionalized polymer strength performance under high pH and/or high alkalinity conditions.

More specifically, one object of the invention is to provide a method for improving the strength performance of the aldehyde functionalized polymer alone or together with other strength additive polymers.

A yet further object of the present invention is to provide a method for increasing paper initial wet strength and improving the wet tensile decay properties when using aldehyde functionalized polymer as paper strength resin.

A still further object of the present invention is to provide a paper product having improved properties.

To achieve at least some of the above objects the invention is characterized by the features of the independent claims. Dependent claims represent the preferred embodiments of the invention.

The invention is based on the finding that it is possible to improve the strength performance of the aldehyde functionalized polymer and thereby to improve the strength properties of paper. An efficient method for the adjustment of the pH in the vicinity of the aldehyde functionalized polymer in papermaking for improving the strength performance of the aldehyde functionalized polymer is disclosed by the present invention.

Even though the glyoxylated polyacrylamide is applied in the examples, the method of the present invention is applicable also to other aldehyde functionalized polymers.

Hence, in one aspect, the present invention provides a method for producing paper, which includes the steps of

- producing a pulp slurry;
- forming a paper sheet from the pulp slurry;
- adding at least one aldehyde functionalized polymer in combination with at least one additional strength additive to said pulp slurry before and/or after the paper sheet formation;
- adding water soluble acid onto the formed paper sheet.

In a second aspect, the present invention provides a paper product produced by the disclosed method.

The method of the present invention has various advantages. One important advantage is that the addition of acid to adjust the pH in the immediate environment of at least one additional strength additive in combination with an aldehyde functionalized polymer, such as GPAM, improves the strength performance of the aldehyde functionalized polymer, such as GPAM, and as a result improves significantly the strength properties of various paper products. Another important advantage is that the method is technically simple to perform and therefore very cost efficient. When the water soluble acid is added on the surface of the paper, the alkalinity is effectively removed from the sheet layer by using low amount of the acid. If the acid were added to the pulp slurry before sheet formation, the dosage of the acid would be orders of magnitude higher in order to neutralize alkalinity in the papermaking water system.

The present invention may also increase the wet tensile decay rate, which is desired e.g. for easier repulping and dispersibility in water upon introduction into sewage.

DETAILED DESCRIPTION OF THE INVENTION

The present invention provides a method for producing paper with improved strength properties.

As used herein, the terms "paper" or "paper product" which can be used interchangeably, are understood to include a sheet material that contains paper fibers, which may also contain other materials (e.g. organic particles, inorganic particles, and a combination thereof). Suitable paper fibers include natural and synthetic fibers, for example, cellulosic fibers, wood fibers of all varieties used in papermaking, other plant fibers, such as cotton fibers, fibers derived from recycled paper; and the synthetic fibers, such as rayon, nylon, fiberglass, or polyolefin fibers. Natural fibers may be mixed with synthetic fibers. For instance, in the preparation of the paper product, the paper web, or paper material may be reinforced with synthetic fibers, such as nylon or fiberglass, or impregnated with nonfibrous materials, such as plastics, polymers, resins, or lotions. As used herein, the terms "paper web" and "web" are understood to include both forming and formed paper sheet materials, papers, and paper materials containing paper fibers. The paper product may be a coated, laminated, or composite paper material. Moreover, the paper product can be bleached or unbleached.

Paper can include, but is not limited to, writing papers and printing papers, such as uncoated mechanical, total coated paper, coated free sheet, coated mechanical, uncoated free sheet, and the like; industrial papers, tissue papers of all varieties, paperboards, cardboards, packaging papers, such as unbleached kraft paper or bleached kraft paper, wrapping papers, paper adhesive tapes, paper bags, paper cloths, toweling, wallpapers, carpet backings, paper filters, paper mats, decorative papers, disposable linens and garments, and the like.

Paper can include tissue paper products. Tissue paper products include sanitary tissues, household tissues, industrial tissues, facial tissues, cosmetic tissues, soft tissues, absorbent tissues, medicated tissues, toilet papers, paper towels, paper napkins, paper cloths, paper linens, and the like.

In an exemplary embodiment, tissue paper may be a felt pressed tissue paper, a pattern densified tissue paper, or a high bulk, uncompacted tissue paper. In another exemplary embodiment, the tissue paper may be creped or uncreped, of a homogeneous or multilayered construction, layered or non-layered (blended), and one-ply, two-ply, or three or more plies. In an exemplary embodiment, tissue paper includes soft and absorbent paper tissue products that are consumer tissue products.

"Paperboard" is paper that is thicker, heavier, and less flexible than conventional paper. Many hardwood and softwood tree species are used to produce paper pulp by mechanical and chemical processes that separate the fibers from the wood matrix. Paperboard can include, but is not limited to, semi-chemical paperboard, linerboards, containerboards, corrugated medium, folding boxboard, and carton boards.

In an exemplary embodiment, paper refers to a paper product such as dry paper board, fine paper, towel, tissue, and newsprint products. Dry paper board applications include liner, corrugated medium, bleached, and unbleached dry paper board.

In an embodiment, paper can include carton board, container board, and special board/paper. Paper can include boxboard, folding boxboard, unbleached kraft board, recycled board, food packaging board, white lined chipboard, solid bleached board, solid unbleached board, liquid paper board, linerboard, corrugated board, core board, wallpaper base, plaster board, book bindery board, wood pulp board, sack board, coated board, gypsum board and the like.

"Pulp" refers to a fibrous cellulosic material. Suitable fibers for the production of the pulps are all conventional grades, for example mechanical pulp, bleached and unbleached chemical pulp, recycled pulp, and paper stocks obtained from all annuals. Mechanical pulp includes, for example, groundwood, thermomechanical pulp (TMP), chemo thermochemical pulp (CTMP), alkaline peroxide mechanical pulp (APMP), groundwood pulp produced by pressurized grinding, semi-chemical pulp, high-yield chemical pulp and refiner mechanical pulp (RMP). Examples of suitable chemical pulps are sulfate, sulfite, and soda pulps. The unbleached chemical pulps, which are also referred to as unbleached kraft pulp, can be particularly used.

"Pulp slurry" refers to a mixture of pulp and water. The pulp slurry is prepared in practice using water, which can be partially or completely recycled from the paper machine. It can be either treated or untreated white water or a mixture of such water qualities. The pulp slurry may contain interfering substances, such as fillers. The filler content of paper may be up to about 40% by weight. Suitable fillers are, for example, clay, kaolin, natural and precipitated chalk, titanium dioxide, talc, calcium sulfate, barium sulfate, alumina, satin white or mixtures of the stated fillers.

"Papermaking process" is a method of making paper products from pulp comprising, inter alia, forming an aqueous pulp slurry that can include cellulosic fiber, draining the pulp slurry to form a sheet, and drying the sheet. The steps of forming the papermaking furnish, draining, and drying may be carried out in any conventional manner generally known to those skilled in the art.

"Paper strength" means a property of a paper material, and can be expressed, inter alia, in terms of dry strength and/or wet strength.

"Dry tensile strength" (also called dry strength) is the tensile strength exhibited by the dry paper sheet, typically conditioned under uniform humidity and room temperature conditions prior to testing. Dry tensile strength is measured by applying a constant-rate-of-elongation to a sample and recording the force per unit width required to break a specimen. The test can be carried out as described in TAPPI Test Method T494 (2001), and modified as described in the examples.

Initial wet tensile strength (also called initial wet strength) test method is used to determine the initial wet tensile strength of paper or paperboard that has been in contact with water for 2 seconds. A 1-inch wide paper strip sample is placed in the tensile testing machine and wetted on both strip sides with deionized water by a paint brush. After the contact time of 2 seconds, the strip is elongated as set forth in 6.8-6.10 TAPPI test method 494 (2001). The initial wet tensile strength is useful in the evaluation of the performance characteristics of tissue product, paper towels and other papers subjected to stress during processing or use while instantly wet.

Permanent wet tensile strength (also called permanent wet strength) test method is used to determine the wet tensile strength of paper or paperboard that has been in contact with water for an extended period of 30 minutes, A 1-inch wide paper strip sample is soaked in water for 30 minutes and is placed in the tensile testing machine. The strip is elongated as set forth in 6.8-6.10 of TAPPI Test Method 494(2001). A low permanent wet tensile strength indicates that the paper product can be repulped in water without significant mechanical energy or dispersed in water easily without clogging sewage systems.

Wet tensile decay is used to measure the percentage of wet tensile loss of permanent wet tensile strength as compared to initial wet tensile strength. Wet tensile decay is defined as the difference between the initial wet tensile strength and the permanent wet strength, divided by the initial wet strength.

Common means for controlling paper strength is the choice of fibers and their mechanical treatment (refining). Virgin fibers, especially Kraft softwood, produce the strongest sheet, but this pulp is costly. Driven by the high cost of virgin fibers and also by environmental pressure, especially the tissue industry has moved towards greater use of less expensive recycled fibers, which inherently produce a weaker sheet. Furthermore, the quality and availability of recycled fibers have been deteriorating dramatically in the latest decade, creating challenges for the papermaking industry. Improving paper dry strength by increased refining is not trouble-free because it increases also dusting during production.

Combination of improved dry and wet strength is desirable because it allows increased running speeds and thus increases productivity. In tissue and towel production, it is also common to follow the wet/dry ratio, which is the wet tensile strength expressed as a percentage of the dry tensile strength. Since a higher dry tensile is associated with a stiffer sheet, a high wet/dry ratio is preferred for tissue and towel to minimize a negative impact on handfeel softness. In addition to strength properties, also appearance related characteristics such as brightness and shade are important for many paper grades and their improvement is desired.

"Aldehyde functionalized polymer" means a synthetic or natural polymer comprising aldehyde functionalities along the polymer backbone and/or along the side chains of the polymer, and it is capable of forming acetal bonds with cellulose to increase paper initial wet strength.

The present invention provides in particular a method, where strength additive polymer(s), comprising at least one aldehyde functionalized polymer, is/are used as paper strength resin. The aldehyde functionalized polymer performance is improved by lowering the pH in the environment or vicinity of the aldehyde functionalized polymer. The aldehyde functionalized polymer itself, alone or together with other strength additive polymers, can be added to the pulp slurry before sheet forming or it can be added after sheet forming on the sheet surface or it can also be added both before and after sheet forming. As the aldehyde functionalized polymer described herein may, itself, be considered a strength additive polymer, the present disclosure encompasses compositions and methods that include an aldehyde functionalized polymer in combination with an additional strength additive, which is not the aldehyde functionalized polymer.

In embodiments, a process of producing paper in accordance with the present disclosure includes at least three steps:

- forming an aqueous slurry i.e. paper slurry, of cellulosic fibers which may be accompanied with other fibers, as well;
- adding a strength additive, and optionally sizing agents, retention aids etc.,
- sheeting and drying the fibers to form a desired cellulosic web.

The forming of an aqueous slurry of cellulosic fibers can be performed by conventional means, such as by mechanical, chemical or semi chemical means. After mechanical grinding and/or pulping step, the pulp is washed to remove residual pulping chemicals and solubilized wood components.

The strength additives, typically wet-strength and dry-strength resins, may be added directly to the papermaking system. As noted above, the compositions and methods of the present disclosure include an aldehyde functionalized polymer in combination with an additional strength additive.

The step of sheeting and drying the fibers to form a cellulosic web may be carried out by conventional means.

Aldehyde functionalized polymers, such as glyoxylated polyacrylamide polymer (GPAM) in particular, possibly together with other strength additive polymers, can be added to the papermaking process at any point in the process where strength resins are usually added. Aldehyde functionalized polymers and other strength additive polymers can be added at any time before, during or after the paper is formed. For example, aldehyde functionalized polymers can be added before, or after the refining of the pulp at the fan pump, or head box, or by spraying or by other means on the wet web. Typically, the aldehyde functionalized polymer is added at the fan pump or machine chest in the form of an aqueous solution.

In one aspect, the method of the present invention for manufacturing paper, includes the steps of

- producing a pulp slurry;
- forming a paper sheet from the pulp slurry;
- adding at least one aldehyde functionalized polymer, in particular glyoxylated polyacrylamide polymer, possibly together with at least one additional strength additive, i.e. a strength additive polymer, to pulp slurry before and/or after the paper sheet formation;
- adding water soluble acid onto the surface of the formed paper sheet.

In an exemplary embodiment, the aldehyde functionalized polymer of the present invention is produced by reacting a compound including one or more hydroxyl, amine, or amide groups with one or more aldehydes. Exemplary materials include urea-formaldehyde resins, melamine-formaldehyde resins, and phenol formaldehyde resins.

In another exemplary embodiment, the aldehyde functionalized polymer compounds include glyoxylated polyacrylamides, aldehyde-functional polysaccharides, aldehyde-rich cellulose, and aldehyde functional cationic, anionic or non-ionic starches.

Exemplary materials include those disclosed in U.S. Pat. No. 4,129,722. One example of a soluble cationic aldehyde functional starch is COBOND® 1000 (National Starch). Additional exemplary materials of aldehyde-functionalized polymers may include polymers such as those disclosed in U.S. Pat. No. 5,085,736; U.S. Pat. No. 6,274,667; and U.S. Pat. No. 6,224,714, as well as those of WO 00/43428 and the aldehyde functional cellulose described in WO 00150462 A1 and WO 01/34903 A1 .

In an exemplary embodiment, the aldehyde functional polymer has a weight average molecular weight of about 1,000 Dalton or greater, advantageously about 5,000 Dalton or greater, more advantageously about 20,000 Dalton or greater. These molecular weights of the aldehyde functional polymer provide good strength response in paper. Alternatively, the aldehyde functionalized polymer can have a molecular weight below about 10 million Dalton, such as below about 1 million Dalton. A very high molecular weight is not preferred for several reasons such as complicating formation which is critical in papermaking. Moreover, it may not provide an enhanced strength performance.

In an exemplary embodiment, further examples of aldehyde functionalized polymers can include dialdehyde guar, aldehyde-functional wet strength additives further comprising carboxylic groups as disclosed in WO 01/83887, dialdehyde inulin, and the dialdehyde-modified anionic and amphoteric polyacrylamides of WO 00/11046.

In another exemplary embodiment, aldehyde-functionalized polymer is an aldehyde-containing surfactant such as those disclosed in U.S. Pat. No. 6,306,249.

In one embodiment, the aldehyde functionalized polymer has at least 5 milliequivalents (meq) of aldehyde per 100 grams of polymer, more specifically at least 10 meq, most specifically about 20 meq or greater, such as about 25 meq per 100 grams of polymer or greater. A higher the aldehyde content increases the strength due to higher number of bonds with cellulose. The aldehyde content of the aldehyde functionalized polymer may be determined by NMR, by UV— or colorimetric methods using dyes or labelling, by a method utilizing conductometric titration of carboxyls as disclosed in WO 00/50462, or by any other known method.

In one embodiment of the present invention the aldehyde functionalized polymer is glyoxylated polyacrylamide polymer (GPAM). GPAM provides enhanced paper dry strength and wet strength. As a synthetic polymer, it has controlled properties, improved stability, lower gelling tendency, and resistance towards microbial degradation, compared to natural aldehyde functionalized polymers. Additionally, GPAM provides better product safety compared to many other synthetic aldehyde functionalized polymers, such as those manufactured using formaldehyde. In one embodiment the aldehyde functionalized polymer is preferably charged glyoxylated polyacrylamide polymer, more preferably cationic glyoxylated polyacrylamide polymer. In an exemplary embodiment the GPAM is a cationic glyoxylated polyacrylamide as described in U.S. Pat. Nos. 3,556,932, 3,556,933, 4,605,702, 7,828,934, and US 20080308242. Such compounds further include commercial products FENNOBOND™ 3000 and FENNOREZ™ 91 (Kemira Oyj).

In an exemplary embodiment, the aldehyde functionalized polymer is a glyoxylated polyacrylamide having the ratio of the number of substituted glyoxal groups to the number of glyoxal-reactive amide groups being in excess of about 0.03:1, being in excess of about 0.10:1, or being in excess of about 0.15:1. The higher ratio results in increased paper strength properties.

In an exemplary embodiment, the aldehyde functionalized polymer is a glyoxalated cationic polyacrylamide having a polyacrylamide backbone with a molar ratio of acrylamide to cationic monomer, such as dimethyldiallylammonium chloride, of about 99:1 to 50:50, about 98:1 to 60:40, or about 96:1 to 75:25. The presence of cationic charge in GPAM renders it self-retaining on cellulose, thereby facilitating the covalent bond formation between GPAM and the cellulose upon drying.

In an exemplary embodiment, the weight average molecular weight of the polyacrylamide backbone of the glyoxalated polyacrylamide is about 5 million Dalton or less, about 1 million Dalton or less, or about 100,000 Dalton or less.

The aldehyde functionalized polymer may be in a form of a complex with another polymer. The complex formation may be based on opposite charges and/or covalent bonding. The aldehyde functionalized polymer may be in a form of a complex with any known paper additive polymer capable of forming complex with the aldehyde functionalized polymer, such as PAE, PPAE, or anionic polyacrylamide.

Advantageously, the aldehyde functionalized polymer is used together with at least one additional strength additive to provide improved strength properties. These additional strength additives include cationic polyamines, anionic polyacrylamides (APAM), cationic polyamide epichlorohydrin, polyvinylamine, polyethyleneimine, or mixtures thereof.

In an exemplary embodiment, the additional strength additive is a cationic polyamine, which is preferably selected from a secondary polyamine, an aliphatic amine, an aromatic amine, a polyalkylene polyamine (such as polyethylene polyamine, a polypropylene polyamine, a polybutylene polyamine, a polypentylene polyamine, a polyhexylene polyamine), a secondary aliphatic amine or a secondary aromatic amine. Advantageously, the cationic polyamine is selected from ethylene diamine (EDA), diethylenetriamine (DETA), triethylenetetramine (TETA), tetraethylenepentamine (TEPA), and dipropylenetriamine (DPTA), bis-hexamethylenetriamine (BHMT), N-methylbis (aminopropyl)amine (MBAPA), aminoethyl-piperazine (AEP), pentaethylenehexamine (PEHA), polyethyleneimine, and other polyalkylenepolyamines (e.g., spermine, spermidine), or mixtures thereof. For example, ethylene diamine (EDA), diethylenetriamine (DETA), triethylenetetramine (TETA), tetraethylenepentamine (TEPA), and dipropylenetriamine (DPTA) can be obtained in a reasonably pure form, but also as mixtures and various crude polyamine materials. For example, the mixture of polyethylene polyamines obtained by the reaction of ammonia and ethylene dichloride, refined only to the extent of removal of chlorides, water, excess ammonia, and ethylenediamine, is a satisfactory material. The cationic polyamines may further include polyamidoamine which is a condensation product of one or more of the polycarboxylic acids and/or a polycarboxylic acid derivatives with one or more of the polyalkylene polyamines such as dimethyl adipate, dimethyl malonate, diethyl malonate, dimethyl succinate, dimethyl glutarate and diethyl glutarate. The reaction kinetics of the selected chemicals differs, but they all react with aldehyde functionalized polymer and therefore further improve strength properties.

In an exemplary embodiment, the additional strength additive is anionic polyacrylamide (APAM), which is preferably a copolymer of anionic monomer and non-ionic monomers such as acrylamide or methacrylamide. Examples of suitable anionic monomers include acrylic acid, methacrylic acid, methacrylamide 2-acrylamido-2-methylpropane sulfonate (AMPS), styrene sulfonate, and mixture thereof as well as their corresponding water soluble or dispersible alkali metal and ammonium salts. The anionic high molecular weight polyacrylamides useful in this invention may also be either hydrolyzed acrylamide polymers or copolymers of acrylamide or its homologues, such as methacrylamide, with acrylic acid or its homologues, such as methacrylic acid, or with polymers of such vinyl monomers as maleic acid, itaconic acid, vinyl sulfonic acid, or other sulfonate containing monomers. Anionic polyacrylamides may contain sulfonate or phosphonate functional groups or mixtures thereof, and may be prepared by derivatizing polyacrylamide or polymethacrylamide polymers or copolymers. The most preferred high molecular weight anionic polyacrylamides are acrylic acid/acrylamide copolymers, and sulfonate containing polymers such as those prepared by the polymerization of such monomers as 2-acrylamide-2-methylpropane sulfonate, acrylamido methane sulfonate, acrylamido ethane sulfonate and 2-hydroxy-3-acrylamide propane sulfonate with acrylamide or other non-ionic vinyl monomer.

In another exemplary embodiment, the anionic polyacrylamide may further contain monomers other than the above described monomers, more specifically, nonionic monomers and cationic monomers, provided the net charge of the polymer is anionic. Examples of nonionic monomers include dialkylaminoalkyl (meth)acrylates such as dimethylaminoethyl (meth)acrylate; dialkylaminoalkyl (meth)acrylamides such as dialkylaminopropyl (meth)acrylamides; and N-vinylformamide, styrene, acrylonitrile, vinyl acetate, alkyl (meth)acrylates, alkoxyalkyl (meth)acrylates, and the like. Suitable cationic vinyl monomers may include: dimethylaminoethyl methacrylate (DMAEM), dimethylaminoethyl acrylate (DMAEA), diethylaminoethyl acrylate (DEAEA), diethylaminoethyl methacrylate (DEAEM) or their quaternary ammonium forms made with dimethyl sulfate or methyl chloride, Mannich reaction modified polyacrylamides, diallylcyclohexylamine hydrochloride (DACHA HCl), diallyldimethylammonium chloride (DADMAC), methacrylamidopropyltrimethylammonium chloride (MAPTAC), vinylpyridine, vinylimidazole, and allyl amine (ALA).

In an exemplary embodiment, the anionic polyacrylamide may have a standard viscosity higher than 1, preferably higher than 1.5, more preferably higher than 1.8. In an exemplary embodiment, the anionic polyacrylamide resin may have a charge density corresponding to anionic monomer content of about from 1 to 100 mol %, preferably about from 5 to 70 mol %, more preferably about from 10 to 50 mol %, of the total monomer content. Anionic polyacrylamide is especially advantageous when glyoxylated cationic polyacrylamide as the aldehyde functionalized polymer is added at the wet-end, to improve charge balance of the system which is critical for paper making, and thus runnability.

In an exemplary embodiment, the additional strength additive is cationic polyamidoamine epihalohydrin, which is preferably prepared by reacting one or more polyalkylene polyamines and one or more dicarboxylic acid compounds to form a polyamidoamine, and then react the polyamidoamine with epihalohydrin to form the polyamidoamine epihalohydrin resin. Advantageously, the cationic polyamide epihalohydrin includes epichlorohydrin, epifluorohydrin, epibromohydrin, epiiodohydrin, alkyl-substituted epihalohydrins, or a mixture thereof. Most advantageously, the epihalohydrin is epichlorohydrin. These chemicals react suitably with aldehyde functionalized polymer and further improve the strength properties.

In an exemplary embodiment, the additional strength additive is polyvinylamine, which is preferably a homopolymer or a copolymer. Useful copolymers of polyvinylamine include those prepared by hydrolyzing polyvinylformamide to various degrees to yield copolymers of polyvinylformamide and polyvinylamine. Exemplary materials are described in U.S. Pat. Nos. 4,880,497 and 4,978,427. The commercial products are believed to have a molecular weight range of about 300,000 to 1,000,000 Dalton, though polyvinylamine compounds having any practical molecular weight range can be used. For example, polyvinylamine polymers can have a molecular weight range of from about 5,000 to 5,000,000, more specifically from about 50,000 to 3,000,0000, and most specifically from about 80,000 to 500,000. Polyvinylamine compounds that may be used in the present invention include copolymers of N-vinylformamide and other groups such as vinyl acetate or vinyl propionate, where at least a portion of the vinylformamide groups have been hydrolyzed. These chemicals react conveniently with aldehyde functionalized polymer and further improve strength properties.

In an exemplary embodiment, the additional strength additive is polyethyleneimine, which is preferably obtained by cationically initiated polymerization of ethyleneimines and also the reaction products of the polymers with, for example, ethylene oxide, propylene oxide, dialkyl carbonates such as ethylene carbonate or propylene carbonate, lactones such as butyrolactone, urea, formaldehyde-amine mixtures, carboxylic acids such as formic acid, acetic acid or vinylacetic acid. Such reaction products may contain, based on the polyethyleneimine, up to 400% by weight of ethylene oxide and/or propylene oxide and up to 200% by weight for the other compounds. Ethyleneimines are polymerized cationically using as the catalyst for example Bronsted acids such as sulfuric acid, phosphoric acid, p-toluenesulfonic acid or carboxylic acids such as formic acid, acetic acid or propionic acid or Lewis acids such as halides, for example zinc chloride or alkyl halides such as methyl chloride, ethyl chloride, benzyl chloride or ethylene chloride. Suitable polyethyleneimines can also be obtained by reacting ethylene chloride with ammonia and amines. The molecular weights of the polyethyleneamines are within the range from 400 to 200,000, and preferred polyethyleneimines are obtainable by polymerizing ethyleneimine. Polymers of this kind are commercial products. In addition, it is also possible to use polyalkylenepolyamines containing from 10 to 4,500 nitrogen atoms in the molecule.

The amount of the additional strength additive used in making papers in accordance with the present disclosure may vary. In embodiments, the additional strength additive may be present in the finished paper in amounts from about 0.1 lb/short tons to about 40 lb/short tons (oven dry paper), in embodiments from about 0.5 lb/short tons to about 25 lb/short tons (oven dry paper).

The weight ratio of aldehyde functionalized polymer to additional strength additive, in embodiments an anionic polyacrylamide, may be from about 1:100 to about 100:1, in embodiments from about 1:20 to about 20:1.

When the paper sheet is formed water soluble acid is applied onto the surface of the formed sheet. The acid is preferably in liquid form, more preferably the acid is an aqueous solution.

By the term "acid" herein is meant chemicals or substances having the property of an acid. Acids include acidic materials functioning as acids in the paper manufacturing environment. There are three common definitions available for acids: the Arrhenius definition, the Brønsted-Lowry definition, and the Lewis definition. The Arrhenius definition defines acids as substances which increase the concentration of hydrogen ions ($H^+$), or more accurately, hydronium ions ($H_3O^+$), when dissolved in water. The Brønsted-Lowry definition is an expansion: an acid is a substance which can act as a proton donor. By this definition, any compound which can easily be deprotonated can be considered an acid. Examples include alcohols and amines which contain O—H or N—H fragments. A Lewis acid is a substance that can accept a pair of electrons to form a covalent bond. Examples of Lewis acids include all metal cations, and electron-deficient molecules such as boron trifluoride and aluminum trichloride. Depending on the chosen chemical to be applied in the method of the present invention all definitions may be applied.

In one embodiment of the present invention water soluble acid having a relative acidity (RA) value greater than 0.05 g/kg dry paper, preferably 0.15 g/kg dry paper or more, is added onto the surface of the formed paper sheet.

The Relative Acidity (RA) is defined as $$RA = \frac{TA \times V_a}{m_{paper}}$$

where TA is the total acidity of the applied acid solution in $CaCO_3$ equivalent (g/l), $V_a$ is the volume (l) of the applied acid solution, and $m_{paper}$ is the mass (g) of treated paper (g). TA can be determined experimentally by neutralizing the acid solution above pH 8.3 with a standard NaOH solution (phenolphthalein indicator). TA is calculated as $$TA = \frac{V_b \times N_b \times EW(CaCO_3)}{V'_a}$$

where $V_b$, is the volume (l) of the standard NaOH solution required to raise the composition pH above 8.3 (phenolphthalein acidity), $N_b$ is the normality (eq/l) of the standard NaOH solution, $EW(CaCO_3)$ is the equivalent weight of $CaCO_3$ which is 50 g/eq, and $V'_\alpha$ is the volume (l) of the acid solution being titrated. Commercial titration kits can also be applied to determine TA. Examples of commercial TA titration kits are HACH Acidity Test Kit Model AC DT and HACH Acidity Test Kit Model AC-6.

RA values, for example for citric acid, can also be estimated theoretically based on the following equation $$RA\ (\text{citric}) = d_c \times \frac{EW(CaCO_3)}{EW(\text{acid})}$$

where $d_c$ is the dosage of applied acid in g(acid)/kg(dry paper), and EW(acid) is the equivalent weight of the applied acid. In this example, the equivalent weight of citric acid EW(citric acid) is 64.04 g/eq, which is the molar mass 192.12 $g \cdot mol^{-1}$ divided by number of acid groups which is three.

In various embodiments of the invention an aldehyde functionalized polymer together with at least one additional strength additive, and the acid can be premixed into a composition and added onto the sheet simultaneously, or added separately onto the sheet.

In one embodiment the aldehyde functionalized polymer together with at least one additional strength additive is added to pulp slurry before the paper sheet formation to enhance paper strength properties. By addition to pulp slurry the strength properties across the Z direction of the paper are more uniform. Especially when producing paper grades using virgin fibers, addition to pulp slurry improves strength response. Furthermore, addition to pulp slurry may improve also retention and drainage.

In one embodiment the aldehyde functionalized polymer together with at least one additional strength additive is added after the paper sheet formation onto the paper sheet surface to enhance paper strength properties. When producing certain recycled paper grades addition onto the paper sheet surface may provide better strength response.

In one embodiment the aldehyde functionalized polymer together with at least one additional strength additive and the water soluble acid are added separately onto the surface of the paper sheet to enhance paper strength properties under adverse papermaking conditions such as high pH and high alkalinity.

In one embodiment a mixture of the water soluble acid and the aldehyde functionalized polymer together with at least one additional strength additive is prepared. Optionally, they are premixed into a composition. The mixture is added onto the surface of the paper sheet to enhance paper strength properties. This embodiment provides simplicity to the process as feeding of only one mixture is needed.

The dosages of the aldehyde functionalized polymer, such as GPAM, are commonly based on dry chemical mass and dry fiber mass. In one embodiment the dosage is up to 30 lbs of the polymer, preferably GPAM, per short tons dry fiber.

In another embodiment the dosage is up to 15 lb/short tons. The GPAM is typically prepared by reacting glyoxal with a polyacrylamide base polymer.

By way of example only, the acid may be applied on the formed paper web by any of the following methods or combinations thereof.

The acid is applied as a spray to a fibrous web. For example, spray nozzles may be mounted over or under a moving paper web to apply a desired dose of an acid solution to the web which may be moist or substantially dry.

Application of the acid by spray or other means to a moving belt or fabric which in turn contacts the tissue web to apply the acid to the web, such as is disclosed for example in WO 01/49937.

The acid may be applied by printing onto a web, such as by offset printing, gravure printing, flexographic printing, ink jet printing, digital printing of any kind, and the like.

The acid may be applied by coating onto one or both surfaces of a web, such as blade coating, air knife coating, short dwell coating, cast coating, and the like.

The acid may be applied to individualized fibers. For example, comminuted or flash dried fibers may be entrained in an air stream combined with an aerosol or spray of the compound to treat individual fibers prior to incorporation to a web or other fibrous product.

The acid may be applied by impregnation into a wet or dry web from a solution or slurry.

One useful method for impregnation of a moist web is the HYDRA-SIZER® system, produced by Black Clawson Corp., Watertown, N.Y., as described in "New Technology to Apply Starch and Other Additives," Pulp and Paper Canada, 100(2): T42-T44 (February 1999), This system includes a die, an adjustable support structure, a catch pan, and an additive supply system. A thin curtain of descending liquid or slurry is created which contacts the moving web beneath it. Wide ranges of applied doses of the coating material are achievable with good runnability. The system can also be applied to curtain coat a relatively dry web, such as a web just before or after creping.

The acid may be applied by foam application to a fibrous web (e.g., foam finishing), either for topical application or for impregnation into the web under the influence of a pressure differential (e.g., vacuum-assisted impregnation of the foam). Principles of foam application of additives such as binder agents are described in the following publications: F. Clifford, "Foam Finishing Technology: The Controlled Application of Chemicals to a Moving Substrate," Textile Chemist and Colorist, Vol.10, No. 12, 1978, pages 37-40; C. W. Aurich, "Uniqueness in Foam Application," Proc. 1992 Tappi Nonwovens Conference, Tappi Press, Atlanta, Ga., 1992, pp.15-19; W. Hartmann, "Application Techniques for Foam Dyeing & Finishing", Canadian Textile Journal, April 1980, p. 55; U.S. Pat. No. 4,297,860, "Device for Applying Foam to Textiles," issued Nov. 3, 1981 to Pacifici et al., herein incorporated by reference; and U.S. Pat. No, 4,773, 110, "Foam Finishing Apparatus and Method," issued Sep. 27, 1988 to G. J. Hopkins, herein incorporated by reference.

The acid may be applied by padding of a solution containing said acid into an existing fibrous web.

The acid may further be applied by roller fluid feeding, or roll coating, of a solution containing said acid for application to the web. Roll coating technique is commonly used for the application of a solution, such as liquid adhesives, paints, oils, and coatings, to the surface of a substrate, such as on a web. Roll coaters may include one or multiple rollers in simple or sophisticated arrangement. A roll coating machine works by applying the solution from the surface of a roller to the surface of a substrate. When this happens, a phenomenon known as "film splitting" occurs. The layer of solution on the surface of the roll splits, part of it staying on the roller, and part transferring to the surface of the substrate. The percentage transferring depends on the surface characteristics of both the roller and the substrate. With most roll coaters, there is a control means for controlling the thickness of the coating on the surface of the roller before it contacts the substrate. The three most common approaches to controlling the coating thickness are metering blade, metering roller, and transfer from another roll. In a typical arrangement for a metering blade, the coating is picked up from a reservoir by the application roller, and as the coating clings to the roller and is carried up by the rotation of the roller, only a certain amount passes through the gap between the metering blade and the roll surface. The excess flows back to the tank. Metering blades are usually made with adjustment means, so coating thickness changes are made by moving the blade to open or close the gap.

In one embodiment the acid, the aldehyde functionalized polymer, and/or the at least one additional strength additive are added by spraying, printing, coating, padding, foam application, roller fluid feeding and/or impregnating. Advantageously, the addition of the acid is made by spraying.

In one embodiment the acid, the aldehyde functionalized polymer, and/or the at least one additional strength additive are added by spraying, printing, coating, padding, foam application, roller fluid feeding and/or impregnating.

The acid penetrates a significant distance into the thickness of the web. In one embodiment the penetration is at least 5% of the thickness of the web. In a further embodiment the penetration is at least 10% of the thickness of the web. In yet another embodiment the penetration is more than about 20% of the thickness of the web. Already such a low penetration may provide sufficient strength improvement, while avoiding addition of excess water and chemical consumption. In another embodiment the penetration is at least about 30% of the thickness of the web. In yet another embodiment the penetration is at least about 70% of the thickness of the web. In a preferred embodiment the acid is completely penetrating the web throughout the full extent of its thickness to provide maximum paper strength enhancement as may be required by certain paper grades. The penetration percentage and thereby the restoration of the strength performance of the aldehyde functionalized polymer may be easily adjusted, therefore optimization for each paper grade and purpose is within the skill of an artisan in the field of papermaking.

Higher and lower applied amounts are also within the scope of the present invention. When using aqueous acid solutions some water will be carried into the web in addition to the acid. The wetter the web, the stronger or more concentrated acids are favored. Preferably, the water content of the web will not exceed 95% by weight, whereby the web dryness is maintained at least in 5% to maximize the performance of acid.

In one embodiment, before the acid is applied to an existing web, such as a moist embryonic web, the solids level i.e. amount of solids of the web is at least about 5% by weight i.e., the web includes about 5 grams of dry solids and 95 grams of water.

In one embodiment, the solids level of the web is at least about 10% by weight. In one embodiment, the solids level of the web is at least about 12% by weight. In one embodiment, the solids level of the web is at least about 15% by weight. In one embodiment, the solids level of the web is at least about 18% by weight. In one embodiment, the solids level of the web is at least about 20% by weight. In one embodiment, the solids level of the web is at least about 25% by weight, In one embodiment, the solids level of the web is at least about 30% by weight. In one embodiment, the solids level of the web is at least about 35% by weight, In one embodiment, the solids level of the web is at least about 40% by weight. In one embodiment, the solids level of the web is at least about 45% by weight. In one embodiment, the solids level of the web is at least about 50% by weight, In one embodiment, the solids level of the web is at least about 60% by weight, In one embodiment, the solids level of the web is at least about 75% by weight. In one embodiment, the solids level of the web is at least about 80% by weight. In one embodiment, the solids level of the web is at least about 90% by weight. In one embodiment, the solids level of the web is at least about 95% by weight. In one embodiment, the solids level of the web is at least about 99% by weight. As already discussed above, higher solids level requires less acid.

In one embodiment, the solids level of the web is from 15 to 95%, preferably from 30 to 90% by weight to maximize the performance of the acid.

One skilled in the art will recognize that the acid can be distributed in a wide variety of ways. For example, the acid may be uniformly distributed, or present in a pattern in the web, or selectively present on one surface or in one layer of a multilayered web. In multi-layered webs, the entire thickness of the paper web may be subjected to application of the acid and other chemical treatments described herein, or each individual layer may be independently treated or untreated with the acid and other chemical treatments of the present invention.

In one embodiment, the acid of the present invention is applied to one layer in a multilayer web. Alternatively, in another embodiment at least one layer is treated with significantly less acid than the other layers. For example, an inner layer can serve as an acid treated layer with increased strength or other properties.

If the acid is dissolved into the aldehyde functionalized polymer, such as GPAM, together with the additional strength additive, the composition can be added by any method which confirms even spreading of the acid on the surface. A suitable method is for example spraying, printing, coating, padding, foam application, roller fluid feeding and/or impregnation Advantageously, the addition of acid is made by spraying.

If the acid is added to the pulp slurry, the dosage of the acid is required to be orders of magnitude higher for neutralizing alkalinity in the papermaking water system compared to application onto the web.

In an exemplary embodiment the pH of the pulp slurry is from 4.0 to 9.0, as this range is the most advantageous for papermaking.

In various embodiments of the present invention the add is applied onto the paper sheet in such an amount that the surface of the sheet becomes acidic before drying. The acidity of the paper sheet surface may be measured by standard methods, including standard Tappi methods for measuring the surface pH, such as T509 and T529.

Measured by the above described method, the acid of the present invention may include one or more acids providing a pH value below 8. In one embodiment, the acid includes one or more acids providing a pH value below 7. In one embodiment, the acid includes one or more acids providing a pH value below 6. In one embodiment, the acid includes one or more acids providing a pH value below 5. In another embodiment, the acid includes one or more acids with a pH value below 4 to provide significant paper strength enhancement. Lower pH indicates the product has some acidity, which does not necessarily result in higher strength. However, acidity is required to increase the strength.

Advantageously, the water soluble acid of the present invention includes a mineral acid or organic acid or a mixture thereof to enhance paper strength properties. These acids are relatively strong, easily available and typically used in papermaking.

In one embodiment the acid of the present invention advantageously includes at least one acid selected from the group of mineral acids, such as phosphoric acid, boric acid, sulfuric acid, hydrochloric acid or the like, to enhance paper strength properties. Mineral acids are strong acids. Even partly deprotonated mineral acids may be used.

In one embodiment the acid of the present invention advantageously includes at least one acid selected from the group of an organic acid, such as formic acid, acetic acid, citric acid, malic acid, lactic acid, or the like to increase acidity without lowering the paper sheet pH significantly. Moreover, organic acids are safe to use. Formic acid, acetic acid and lactic acid are totally miscible with water enabling any desired concentration. The solubility of citric acid in 20° C. water is about 1478 g/l, and the solubility of malic acid is 558 g/l.

In one embodiment the acid of the present invention includes acrylic acid-containing polymers or the like which are paper strength resins or processing aids such as retention, formation, drainage or flocculants by themselves, thereby providing additional papermaking process enhancement.

In one embodiment the acid of the present invention includes acids which are not capable of reacting with the aldehydes of the aldehyde-functionalized polymer.

In one embodiment the acid of the present invention includes a conjugate acid of a weak base, in particular, ammonium chloride, or the like which can be applied without lowering water pH significantly. Amines as such are weak bases but when protonated into their conjugated acids they become acidic. Salts formed e.g. with strong acids yield an acidic water solution.

In one embodiment the acid of the present invention includes acidic material that is capable of reacting with the aldehydes of the aldehyde-functionalized polymer, in particular, an amine-containing polymer in protonated form or in salt form, such as polyvinylamine, polyethyleneimine, polyamidoamine prepared by reacting adipic acid with diethylenetriamine, polyamidoamine epichlorohydrin, or the like, in salt form. The aldehyde-reactive polymers enhance paper strength properties by lowering water pH and also reacting with aldehydes.

In some embodiments of the invention the acid may be a mixture of any of the acids listed above or their salts.

The acid of the present invention is soluble in water. The solubility is preferably at least 0.1 g/l at 20° C., depending on the pKa value of the acid or pH value obtainable at the paper sheet surface. More preferably, the water solubility is at least 500 g/l at 20° C. Most preferably, the acid is totally miscible, enabling any desired application concentration.

The method as disclosed herein can be applied to various paper grades and pulp slurries. The pulp slurry may include softwood or hardwood or any of their combination. Softwood is typically spruce or pine. Hardwood is typically eucalyptus, aspen or birch. In some embodiments the pulp slurry is prepared at least partly from recycled paper.

In one embodiment the pulp includes softwood pulp, hardwood pulp, recycled paper, or a mixture thereof.

In one embodiment the pulp slurry of the present invention is a mixture of softwood pulp and/or hardwood pulp, and recycled paper.

In one embodiment the pulp slurry of the present invention is prepared from recycled paper.

Recycled paper often contains precipitated alkaline agents, such as calcium carbonate (PCC) and ground calcium carbonate (GCC). When PCC and GCC are re-introduced into the papermaking process they increase the system alkalinity.

In one embodiment the pulp includes precipitated calcium carbonate (PCC), ground calcium carbonate (GCC) and/or recycled paper.

The method of the present invention is suitable for applications where precipitated calcium carbonate (PCC) filler is added to printing/writing paper, since carbonate ions from PCC dissolve in water, leading to high alkalinity and high pH.

In one embodiment at least one alkaline agent is introduced to said pulp slurry or after sheet forming.

In one embodiment of the present invention a method is provided which includes the steps of producing a pulp slurry;

adding an alkaline agent, advantageously such as PCC, to said pulp slurry before or after sheet formation, unless the pulp slurry already originally contains an alkaline agent;

adding at least one aldehyde functionalized polymer in combination with at least one additional strength additive before or after the paper sheet formation;

forming a paper sheet from the pulp slurry;

adding water soluble acid onto the formed paper sheet.

The alkaline agents or reagents to be used in the process of the present invention may be dry or encapsulated reagents i.e. not aqueous reagent solutions, that are soluble in water. The dissolution or the release of alkaline agents in water may occur over an extended period time, preferably over 10 seconds, more preferably over 30 seconds. Consequently, the pH of paper sheet remains acidic or neutral in the dryer section during the papermaking process to facilitate acetal bonding formation between cellulose and aldehydes. Upon sufficient contact of the tissue product with water, the alkaline agent functions by neutralizing the added water soluble acid and degrading the aldehyde-fiber bonds in the fibrous sheet.

The neutralization process is preferred to occur over an extended period of time, for example more than 10 seconds, more preferably more than 30 seconds.

Examples of suitable alkaline agents include, but and are not limited to, magnesium hydroxide, calcium hydroxide, magnesium bisulfite, magnesium oxide, zinc oxide, sodium sulfite, magnesium carbonate, magnesium carbonate-magnesium hydroxide ($(MgCO_3)_4Mg(OH)_2$), sodium oxide-aluminum oxide ($Na_2O\ Al_2O_3$), sodium carbonate, sodium bicarbonate, sodium benzoate, calcium carbonate, calcium bicarbonate, sodium acetate, and combinations thereof.

In another embodiment, water-activatable microspheres are filled with an alkaline reagent, and then applied to the tissue product as either a lotion add-on, a spray add-on, or a printed add-on, for instance, a rotogravure printed add-on. The microspheres disintegrate or disperse upon sufficient contact with water and allow the alkaline reagent to degrade the tissue. In these and other embodiments where the alkaline reagent is encapsulated or otherwise retained in combination with another material until its water-induced release, the release of the alkaline reagent may be controlled so that certain amounts of reagent are dispersed over a specified time period i.e. the alkaline reagent is time-released.

Advantageously, the alkaline agent is introduced into the pulp slurry before adding at least one aldehyde functionalized polymer in combination with at least one additional strength additive to said pulp slurry to increase paper wet tensile decay rate.

In one embodiment the pulp slurry contains at least one alkaline agent. The alkaline agent may be originally contained within the pulp slurry.

In another embodiment of the present invention a method is provided comprising the following steps:

producing a pulp slurry;

adding an alkaline agent, advantageously such as PCC, to said pulp slurry before or after sheet formation, unless the pulp slurry already originally contains an alkaline agent;

adding at least one aldehyde functionalized polymer together with a high molecular weight anionic polyacrylamide before or after the paper sheet formation;

adding at least one additional strength additive, advantageously such as anionic polyacrylamide, and polyamidoamine epichlorohydrin before or after paper sheet formation;

forming a paper sheet from the pulp slurry;

adding water soluble acid onto the formed paper sheet.

As the performance of GPAM is highly dependent on the water chemistry the papermakers often deliberately lower the pulp slurry pH to increase the GPAM efficiency. Lowering the pH decreases the wet tensile decay rate for the treated paper, and leads to poor paper dispersibility in water. Using the method of the present invention it is not necessary to lower the pulp pH to increase the efficiency of the GPAM. By locally decreasing the pH of the web sheet by water soluble acid will create an acidic pH environment for GPAM, thereby restoring its efficiency. Wet tensile decay percentage of at least 70%, preferably more than 80%, has been obtained for the paper produced by the method of the present invention. At the same time the initial wet tensile strength remains high and the permanent wet tensile strength low.

In various embodiments the acid may be added before and/or after the addition of aldehyde functionalized polymer, such as GPAM, in combination with at least one additional strength additive, or acid and aldehyde functionalized polymer, such as GPAM, in combination with at least one additional strength additive, are combined together, typically by dissolving acid to aldehyde functionalized polymer, such as GPAM, in combination with at least one additional strength additive, and the composition is added on the surface of the sheet.

In another aspect, the present invention provides a paper product produced by the method as described above.

In one embodiment the paper product includes an aldehyde functionalized polymer, such as glyoxylated polyacrylamide polymer, in combination with at least one additional strength additive, such as APAM, and an acid on a paper sheet, which is produced by adding the aldehyde functionalized polymer, such as glyoxylated polyacrylamide polymer, in combination with at least one additional strength additive, such as APAM, to pulp slurry before paper sheet formation, forming a paper sheet from the pulp slurry, and adding acid on the surface of the formed paper sheet having a relative acidity (RA) value greater than 0.05 g/kg dry paper.

In other embodiments, an aldehyde functionalized polymer, such as glyoxylated polyacrylamide polymer, may be added to a pulp slurry, and an additional strength additive and acid may then be added onto the formed sheet. The additional strength additive and acid may be added separately or mixed for easier application to the formed sheet.

In another embodiment, a paper product includes aldehyde functionalized polymer, such as glyoxylated prolyacrylamide polymer, in combination with at least one additional strength additive, such as APAM, and an acid on a paper sheet, which is produced by adding both the aldehyde functionalized polymer, such as glyoxylated prolyacrylamide polymer, in combination with at least one additional strength additive, such as APAM, and the acid on the surface of a paper sheet formed from a pulp slurry.

In embodiments, the three components, i.e., aldehyde functionalized polymer, additional strength additive and acid, may be combined as a mixture, which is applied to the surface of the paper sheet.

In other embodiments, the three components, i.e., aldehyde functionalized polymer, additional strength additive and acid, may be applied separately onto the surface of the paper sheet.

In embodiments, when the pulp slurry contains at least one alkaline agent a paper product is produced having an increased wet tensile decay compared to a paper product produced without said addition of the alkaline agent.

The method and composition of the present disclosure encompasses the use of aldehyde functionalized polymers, more specifically GPAM; or aldehyde functionalized polymer, more specifically GPAM, together with other strength additive(s).

The method and composition of the present invention is suitable in particular to improve the strength performance of aldehyde functionalized polymer, such as GPAM when the level of alkalinity on sheet surface is high. With alkalinity level of 50 ppm or higher, aldehyde functionalized polymer, such as GPAM strength performance can be improved, if the acidity in the environment of aldehyde functionalized polymer, such as GPAM is lowered to neutral or acidic.

If the alkalinity on the sheet surface is 50 ppm or lower, the strength performance aldehyde functionalized polymer, such as GPAM can be improved already in slightly basic conditions by the method of the present disclosure. The acidity in the environment of aldehyde functionalized polymer, such as GPAM may need to be lowered only from basic to neutral.

The results obtained for a paper produced by the method of the present invention, i.e. by adding at least one aldehyde functionalized polymer to the pulp slurry before and/or after the paper sheet formation and by adding water soluble acid onto the formed paper sheet, show increased dry and wet tensile strength, as well as increased wet to dry ratio, compared to a paper produced without these additions. The dry tensile strength may be increased at least 10% whereas the wet tensile strength value may become 5 fold. The wet to dry ratio may be increased to over 20%.

In one embodiment a paper product is obtained, wherein the wet to dry tensile strength ratio is at least 20%.

The use of the method according to the present invention further improved the brightness and color shade of the manufactured paper product. The increase in brightness may be more than 1% and the b-value of the color shade may decrease significantly.

In one embodiment a paper product is obtained, having an improved brightness compared to a paper product produced without the additions of the at least one aldehyde functionalized polymer and the water soluble acid.

In one embodiment a paper product is obtained, having an improved color shade in terms of a decreased b-value compared to a paper product produced without the additions of the at least one aldehyde functionalized polymer, the at least one additional strength additive, and the water soluble acid.

In yet another aspect, the present disclosure provides a pulp slurry treatment system. This is a set of chemicals i.e. a chemical system for use in a method for manufacturing paper as described above. The pulp slurry treatment system includes the following chemicals:

(i) At least one aldehyde functionalized polymer, in combination with at least one additional strength additive, which is configured to be applied to said pulp slurry before and/or after the paper sheet formation. This application relates to the method for manufacturing paper, including the steps of producing a pulp slurry, forming a paper sheet from the pulp slurry, adding at least one aldehyde functionalized polymer to said pulp slurry before and/or after the paper sheet formation, and adding water soluble acid onto the formed paper sheet.

(ii) A water soluble acid configured to be applied onto the formed paper sheet.

(iii) Optionally, an alkaline agent configured to be introduced to said pulp slurry or to the formed paper sheet i.e. introduced after sheet forming.

The preferred embodiments for the aldehyde functionalized polymer, the at least one additional strength additive, the water soluble acid and the alkaline agent are those already discussed during the method.

The invention is further illustrated by the following non-limiting examples.

EXAMPLES

FENNOBOND 3300 (12% w/w) is a commercial GPAM product of Kemira Chemicals Inc. Commercial precipitated calcium carbonate (PCC) has a scalenohedral particle shape and a median particle size of 1.9 micron. SUPERFLOC® A130 (Kemira Chemicals) was a commercial dry anionic polyacrylamide sample with a weight average molecular weight around 20 million Daltons. FENNOFIX 573 (Kemira Chemicals) was a polyamine product prepared by a condensation reaction of epichlorohydrin and dimethylamine. Anhydrous citric acid (>99.5%), sodium bicarbonate (>99%), sodium sulfate (>99%), and anhydrous calcium chloride (>96%) were purchased from Sigma Aldrich. Strength APAM was a commercial anionic polyacrylamide strength additive (Kemira Chemicals) with a weight average molecular weight of about 300 kDa.

Hand Sheet Preparation Without PCC

Hand sheets were prepared using two pulp mixtures.

The first one was a mixture of bleached northern hardwood (50%) and bleached softwood (50%) with a final Canadian Standard Freeness (CSF) of 450 ml.

The second one was a mixture of bleached softwood (40%) and bleached Eucalyptus pulp (60%). The softwood pulp was refined to 450 ml (CSF) before mixing and the Eucalyptus pulp was dispersed in water without extra refining before mixing.

Both pulp mixtures had a consistency of 0.4 wt %, an alkalinity level of 200 ppm, and a pH value of 7.8. During handsheet preparation, FENNOBOND 3300 and diluted citric acid solution (1 wt %) were first added to the pulp slurry and mixed for 30 seconds (internal treatment). Then, four 3-g sheets of paper were formed using a standard (8"×8") Nobel & Woods handsheet mold, to target a basis weight of 52 lbs/3470 $ft^2$. Pulp dilutions during handsheet preparation were carried out using a specially formulated water to simulate papermaking mill white water. This formulated water contained 150 ppm of sodium sulfate, 35 ppm of calcium chloride, an alkalinity level of 200 ppm alkalinity (adjusted by sodium bicarbonate), and a pH value of 7.8. Next, FENNOBOND 3300 and diluted citric acid solution were sprayed on the surface of wet hand sheets either before or after pressing using a commercial modular sprayer (1550 AutoJet from Spraying Systems Co.) (surface treatment). If both FENNOBOND 3300 and citric acid were required for the same treatment method, they were mixed at the right ratio and applied simultaneously. Hand sheets were then pressed between felts in the nip of a pneumatic roll press at about 204.7 kPa (15 psig) and dried on a rotary dryer at 110° C. for 45 seconds, followed by 5 minutes of curing in an oven at 105° C.. Last, paper samples were conditioned in the standard TAPPI control room for overnights before strength property testing.

Hand Sheet Preparation with PCC

Hand sheets were prepared using the first pulp mixture described above. PCC was first added to the pulp suspension if required. PCC typically increased pulp suspension pH significantly above 7.8 and extra hydrochloric acid was added to lower pH down to 7.8. Next, FENNOBOND 3300 or FENNOFIX 573 was added to the pulp suspension and mixed for 30 seconds. Then, SUPERFLOC A130 was added and mixed for another 2 minutes. Next, four 3-g sheets of paper were formed using a standard (8"×8") Nobel & Woods handsheet mold, to target a basis weight of (52 lbs)/(3470 ft2). Handsheets were then pressed between felts in the nip of a pneumatic roll press at about 15 psig and dried on a rotary dryer at 110 ° C.. If required, chemicals were sprayed on the handsheet uniformly using a commercial modular sprayer (1550 AutoJet from Spraying Systems Co.). Last, paper samples were conditioned in the standard TAPPI control room for overnights before any strength property testing.

Dry Tensile Strength Test

Tensile strength is measured by applying a constant-rate-of-elongation to a sample and recording the force per unit width required to break a specimen. This procedure references TAPPI Test Method T494 (2001), and modified as described.

Initial Wet Tensile Strength Test

Initial wet tensile strength test method is used to determine the initial wet tensile strength of paper or paperboard that has been in contact with water for 2 seconds. A 1-inch wide paper strip sample is placed in the tensile testing machine and wetted on both strip sides with deionized water by a paint brush. After the contact time of 2 seconds, the strip is elongated as set forth in 6.8-6.10 TAPPI test method 494 (2001). The initial wet tensile is useful in the evaluation of the performance characteristics of tissue product, paper towels and other papers subjected to stress during processing or use while instantly wet. This method references U.S. Pat. No. 4,233,411, and is modified as described.

Permanent Wet Tensile Strength Test

Permanent wet tensile strength test is used to determine the wet tensile strength of paper or paperboard that has been in contact with water for an extended period of 30 minutes. A 1-inch wide paper strip sample is soaked in water for 30 minutes and is placed in the tensile testing machine. The strip is elongated as set forth in 6.8-6.10 of TAPPI Test Method 494(2001). A low permanent wet tensile strength indicates that the paper product can be repulped in water without significant mechanical energy or dispersed easily in sewage systems.

Wet/Dry Ratio

Wet/dry ratio is the initial wet tensile strength as expressed as a percentage of dry tensile strength.

Wet Tensile Decay

Wet tensile decay is used to measure the percentage of wet tensile loss of permanent wet tensile strength as compared to initial wet tensile strength.

Decay %=(initial wet tensile strength—permanent wet tensile strength)/initial wet tensile strength Results GPAM internal treatment using the first pulp mixture.

GPAM strength performance is adversely affected by relatively high pH and high levels of alkalinity in pulp slurries. As shown in Table 1 and Table 2, FENNOBOND 3300 alone provided almost no strength improvement for the pulp slurry with a pH value of 7.8 and an alkalinity level of 200 ppm. With 6 lb/short tons of FENNOBOND 3300 being added to the pulp slurry, the wet tensile strength remained the same and the dry tensile strength only increased by 6%. Furthermore, adding 4.5 lb/short tons of citric acid in combination with GPAM to the pulp slurry only led to slight strength improvement. Paper wet tensile strength increased by 22% and dry tensile strength increased by 9%, The pulp slurry used in this study contained about 0.4% dry fiber and 99.6% water with high levels of dissolved bicarbonate ions. The dosage of added citric acid was too low to significantly change pulp pH and alkalinity.

In this study we proposed applying acid materials on the formed paper sheets to enhance GPAM strength performance. During the handsheet making process, over 98% of process water was removed from the pulp and the dry fiber content in the wet paper sheet after wet press was up to 30%. Consequently, low dosages of surface applied citric acid were able to neutralize alkalinity and lower wet paper sheet pH, leading to GPAM strength performance enhancement. With 1.5 lb/short tons of citric acid being sprayed on the wet paper sheet, the initial wet tensile strength increased remarkably by 300% and the dry tensile strength increased by 47%. At 3.0 lb/short tons of citric acid, the wet tensile strength increased almost by 500% and the dry tensile strength increased by 34%.

GPAM surface treatment using the second pulp mixture

Table 3 and Table 4 demonstrated that GPAM can be sprayed together with citric acid to increase paper strength. With 30 lb/short tons of FENNOBOND 3300 being added directly to the pulp slurry, the hand sheets showed low dry tensile strength and low wet tensile strength. The wet/dry ratio was only 5.8% which was only marginally higher than that of blank paper without wet strength resin treatment. Blank paper typically has a wet/dry ratio around 4-5%. Hand sheet strength properties improved slightly when hand sheets were surface-treated with FENNOBOND 3300. At 30 lb/short tons of FENNOBOND 3300, hand sheet dry tensile strength results remained at around 1-12 lb/in range. The surface treatment did increase wet tensile strength slightly from 0.7 to 1.1 lb/in and increase the wet/dry ratio from 5.8% to 8.8%. In contrast, hand sheet strength properties increased considerably when hand sheets were surface treated with 30 lb/short tons of GPAM and 12 lb/short tons of citric acid together. The dry tensile strength increased to 18 lb/short tons (60% increase), wet tensile strength to 4.0 lb/short tons) (almost 500% increase), and the wet/dry ratio to 22.0%. in addition, the GPAM and citric acid combination improved paper brightness and color shade. Paper brightness (Tappi Method T 452) increased by more than 1% and "b value" (Tappi Method T 524) decreased significantly, from 0.65 to −0.14. A more negative "b value" indicates a more "bluish" color shade, which corresponds to a "whiter" paper to human eyes.

Effect of PCC on Wet Strength Decay

Wet strength decay is a critical property for many paper grades. For example, it is highly desirable for bath tissue to have both high initial wet tensile strength and also high wet tensile decay rate. A high decay rate will ensure bath tissue products disperse easily in water without clogging the sewage system. Furthermore, significant amount of paper brakes and off-spec products are often produced during normal papermaking manufacturing. Slow wet tensile decay rate will generate fiber bundles during the repulping process and result in more off-spec products.

Tables 5 and 6 demonstrated the impact of PCC on wet tensile rate. PCC is an alkaline material which is able to react with acidic chemicals to increase solution pH. GPAM was either added to the pulp suspension or sprayed onto the paper sheet with citric acid together. PCC was added to the pulp suspension and retained into the paper sheet using a two-component retention program. When GPAM was added to the pulp suspension, PCC was retained using the cationic GPAM product and a high molecular weight anionic polyacrylamide (APAM) flocculant. When GPAM was sprayed on the paper sheet surface, PCC was retained using a cationic polyamine product and the APAM flocculant. In all cases with PCC, the wet tensile decay percentage was significantly higher than 70%. For example, the wet tensile decay percentage reached 82% when 6 lb/short tons of GPAM and 6 lb/short tons of citric acid were sprayed on the paper sheet surface. In comparison, the treatment of GPAM and citric acid in the absence of PCC resulted in a wet strength decay of only 43%.

Effect of an additional strength additive on strength properties and on wet tensile decay.

TABLE 1

Handsheets preparation methods using a pulp blend containing bleached hardwood (50%) and bleached softwood (50%) with a CSF value of 450 ml. All units are based on lbs of 100% active chemicals per short tons of oven dried (OD) paper.

| Example | GPAM application method | GPAM dosage (lb/short tons) | Citric acid application method | Citric acid dosage (lb/short tons) | Relative acidity of surface added acid (g acid/kg paper) |
|---|---|---|---|---|---|
| 1 | n | n | n | n | 0 |
| 2 | Internal | 6 | n | n | 0 |
| 3 | Internal | 6 | Internal | 1.35 | 0 |
| 4 | Internal | 6 | Internal | 4.5 | 0 |
| 5 | Internal | 6 | Surface (after wet press) | 1.5 | 0.6 |
| 6 | Internal | 6 | Surface (after wet press) | 3.0 | 1.2 |

TABLE 2

Handsheet strength properties

| Example | DT (lb/in) | DT increase (%) | IWT (lb/in) | IWT increase (%) | W/D (%) |
|---|---|---|---|---|---|
| 1 | 18.6 | NA | 0.9 | NA | 4.8 |
| 2 | 19.8 | 6.5 | 0.9 | 0 | 4.5 |
| 3 | 20.3 | 9.1 | 1.1 | 22.2 | 5.4 |
| 4 | 20.3 | 9.1 | 1.1 | 22.2 | 5.4 |
| 5 | 27.4 | 47.3 | 3.6 | 300.0% | 13.1 |
| 6 | 25.0 | 34.4 | 5.2 | 477.8% | 20.8 |

DT = dry tensile strength;

IWT = initial wet tensile strength;

W/D = wet tensile strength expressed as a percentage of the dry tensile strength.

TABLE 3

Handsheets preparation methods using a pulp blend containing bleached *Eucalyptus* (60%) and bleached softwood (40%). The CSF value of bleached softwood was 450 ml. Bleached *Eucalyptus* was dispersed and blended without refining.

| Sample | GPAM application method | GPAM dosage (lb/short tons) | Citric acid application method | Citric acid dosage (lb/short tons) | Relative acidity of surface added acid (g acid/kg paper) |
|---|---|---|---|---|---|
| 7 | Internal | 30 | NA | 0 | 0 |
| 8 | Surface (before wet press) | 30 | NA | 0 | 0 |
| 9 | Surface (before wet press) | 30 | Surface (before wet press) | 12 | 4.7 |

TABLE 4

Handsheet strength and color properties

| Sample | DT (lb/in) | DT increase (%) | IWT (lb/in) | IWT increase (%) | W/D (%) | Brightness | b value |
|---|---|---|---|---|---|---|---|
| 7 | 11.3 | NA | 0.7 | NA | 5.8 | 76.0 | 0.65 |
| 8 | 11.9 | 5.3 | 1.1 | 57.1 | 8.8 | 76.8 | 0.46 |
| 9 | 18.0 | 59.3 | 4.0 | 471.4 | 22.2 | 77.3 | −0.14 |

DT = dry tensile strength;

IWT = initial wet tensile strength;

W/D = wet tensile strength expressed as a percentage of the dry tensile strength

TABLE 5

Handsheet preparation methods

| Example | FENNOBOND 3300 (lb/short tons) | FENNOFIX 573 (lb/short tons) | PCC (%) | SUPERFLOC A-130 (lb/short tons) | Citric acid (lb/short tons) |
|---|---|---|---|---|---|
| 10 | 6.0 (internal) | 0 | 0 | 0.3 (internal) | 0 |
| 11 | 6.0 (internal) | 0 | 0 | 0.3 (internal) | 3.0 (surface, after wet press) |

TABLE 5-continued

| Handsheet preparation methods | | | | | |
|---|---|---|---|---|---|
| Example | FENNOBOND 3300 (lb/short tons) | FENNOFIX 573 (lb/short tons) | PCC (%) | SUPERFLOC A-130 (lb/short tons) | Citric acid (lb/short tons) |
| 12 | 6.0 (internal) | 0 | 4.0 | 0.3 (internal) | 15.0 (surface, after wet press) |
| 13 | 6.0 (surface, after wet press) | 6.0 (internal) | 4.0 (internal) | 0.3% (internal) | 6.0 (surface, after wet press) |
| 14 | 6.0 (surface, after dryer) | 6.0 (internal) | 4.0 (internal) | 0.3% (internal) | 6.0 (surface, after dryer) |

TABLE 6

| Wet strength properties of handsheets | | | | | |
|---|---|---|---|---|---|
| Example | Initial wet tensile (lb/in) | Permanent wet tensile (lb/in) | Decay (%) | Dry Tensile (lb/in) | % Wet/Dry |
| 10 | 1.0 | 0.1 | 90% | 20.0 | 4.8 |
| 11 | 4.6 | 2.6 | 43% | 22.5 | 20.3 |
| 12 | 2.3 | 0.6 | 74% | 20.5 | 10.2 |
| 13 | 3.4 | 0.6 | 82% | 25.3 | 13.4 |
| 14 | 3.5 | 0.8 | 77% | 23.8 | 14.9 |

Additional Examples were prepared as described above, with an alkalinity level of 400 ppm and a pH value of 7.4. The results are summarized in Tables 7 and 8 below.

Tables 7 and 8 demonstrated the impact of APAM as an additional strength additive on strength properties and on wet tensile decay. GPAM alone did not provide strength under high alkalinity/pH conditions based on previous studies. Citric acid moderately enhanced GPAM wet tensile performance. Higher APAM strength additive dosage levels led to higher paper strength properties, but lower wet tensile decay percentage. The best performance was achieved by combination of GPAM, APAM strength additive, and citric acid, which provided high strength properties and high wet tensile decay percentage.

TABLE 7

| Handsheet preparation methods | | | |
|---|---|---|---|
| Example | FENNOBOND 3300 (GPAM) (lb/short tons) | Strength APAM (lb/short tons) | Citric acid (lb/short tons) |
| 15 | 0 | 0 | 0 |
| 16 | 15 (internal) | 0 | 6 (surface, after wet press) |
| 17 | 15 (internal) | 3 (internal) | 0 |
| 18 | 15 (internal) | 6 (internal) | 0 |
| 19 | 15 (internal) | 9 (internal) | 0 |
| 20 | 15 (internal) | 6 (internal) | 6 (surface, after wet press) |

TABLE 8

| Handsheet strength properties | | | | | |
|---|---|---|---|---|---|
| Example | DT (lb/in) | DT increase (%) | IWT (lb/in) | IWT increase (%) | W/D (%) |
| 15 | 14.2 | NA | 0.6 | NA | NA |
| 16 | 16.5 | 16% | 2.8 | 367% | NA |
| 17 | 16.7 | 18% | 1.8 | 200% | 43% |
| 18 | 17.3 | 22% | 2.9 | 383% | 39% |
| 19 | 19.3 | 36% | 3.7 | 517% | 35% |
| 20 | 21.1 | 49% | 4.5 | 650% | 57% |

DT = dry tensile strength;
IWT = initial wet tensile strength;
W/D = wet tensile strength expressed as a percentage of the dry tensile strength.

It should be understood that the examples and embodiments provided herein are exemplary examples and embodiments. Those skilled in the art will envision various modifications of the examples and embodiments that are consistent with the scope of the disclosure herein. Such modifications are intended to be encompassed by the claims.

The invention claimed is:

1. A method for manufacturing paper, which comprises:

producing a pulp slurry;

forming a paper sheet from the pulp slurry including cellulose fibers;

adding at least one aldehyde functionalized polymer in combination with at least one additional strength additive to said pulp slurry or to the formed paper sheet, wherein the at least one aldehyde functionalized polymer covalently bonds to the cellulose fibers; and adding at least one water soluble acid selected from the group consisting of mineral acid, organic acid, acrylic acid containing polymers, conjugate acid of a weak base and amine-containing polymer in protonated form, onto the formed paper sheet.

2. The method according to claim 1, wherein the water soluble acid has a relative acidity (RA) value greater than 0.05 g/kg dry paper.

3. The method according to claim 1, wherein the aldehyde functionalized polymer is a glyoxylated polyacrylamide polymer.

4. The method according to claim 1, wherein the aldehyde functionalized polymer is a charged glyoxylated polyacrylamide polymer.

5. The method according to claim 1, wherein the aldehyde functionalized polymer is a cationic glyoxylated polyacrylamide polymer.

6. The method according to claim 1, wherein the additional strength additive comprises cationic polyamines, anionic polyacrylamides (APAM), cationic polyamide epichlorohydrin, polyvinylamine, polyethyleneimine, or mixtures thereof.

7. The method according to claim 1, wherein the at least one additional strength additive is present in the formed paper sheet in an amount from about 0.1 lb/short tons to about 40 lb/short tons (oven dry paper).

8. The method according to claim 1, wherein the additional strength additive includes an anionic polyacrylamide.

9. The method according to claim 8, wherein the weight ratio of aldehyde functionalized polymer and anionic polyacrylamide is from about 1:100 to about 100:1.

10. The method according to claim 1, wherein the aldehyde functionalized polymer and the additional strength additive are added to said pulp slurry before paper sheet formation.

11. The method according to claim 1, wherein the aldehyde functionalized polymer is added to said pulp slurry before paper sheet formation and the additional strength additive is added after the paper sheet formation onto the paper surface.

12. The method according to claim 11, wherein the additional strength additive, and the water soluble acid are added separately onto the surface of the paper sheet.

13. The method according to claim 11, wherein a mixture of the additional strength additive, and the water soluble acid is added onto the surface of the paper sheet.

14. The method according to claim 1, wherein the acid is added by spraying, printing, coating, padding, foam application, roller fluid feeding and/or impregnating.

15. The method according to claim 1, wherein the aldehyde functionalized polymer is added by spraying, printing, coating, padding, foam application, roller fluid feeding and/or impregnating.

16. The method according to claim 1, wherein the water solubility of the water soluble acid is more than 0.1 g/l at 20° C.

17. The method according to claim 1, wherein the water soluble acid is a mineral acid, organic acid or a mixture thereof.

18. The method according to claim 17, wherein the mineral acid is phosphoric acid, boric acid, sulfuric acid, hydrochloric acid, or any mixture thereof.

19. The method according to claim 17, wherein the organic acid is formic acid, acetic acid, citric acid, lactic acid or malic acid, or any mixture thereof.

20. The method according to claim 1, wherein the water soluble acid is an acrylic acid-containing polymer, a conjugate acid of a weak base or a mixture thereof.

21. The method according to claim 1, wherein the acid comprises a mixture of acids.

22. The method according to claim 1, wherein the pulp is softwood pulp, hardwood pulp, recycled paper, or a mixture thereof.

23. The method according to claim 1, wherein the pulp comprises precipitated calcium carbonate (PCC), ground calcium carbonate (GCC) and/or recycled paper.

24. The method according to claim 1, wherein the pulp slurry contains at least one alkaline agent.

25. The method according to claim 1, wherein at least one alkaline agent is introduced to said pulp slurry before or after sheet forming.

26. The method according to claim 25, wherein the alkaline agent is dry or encapsulated reagent that is soluble in water.

27. The method according to claim 25, wherein the alkaline agent dissolves or is released in water over 10 seconds.

28. The method according to claim 25, wherein the alkaline agent dissolves or is released in water over 30 seconds.

29. The method according to claim 25, wherein the alkaline agent is selected from the group consisting of magnesium hydroxide, calcium hydroxide, magnesium bisulfite, magnesium oxide, zinc oxide, sodium sulfite, magnesium carbonate, magnesium carbonate-magnesium hydroxide ($(MgCO_3)_4Mg(OH)_2$), sodium oxide-aluminum oxide ($Na_2O\ Al_2O_3$), sodium carbonate, sodium bicarbonate, sodium benzoate, calcium carbonate, calcium bicarbonate, sodium acetate, and combinations thereof.

30. The method according to claim 1, wherein the water soluble acid is added on the paper sheet in such an amount that the surface of the sheet becomes acidic before entering dryer section.

31. The method according to claim 1, wherein the water soluble acid is added on the paper sheet web having a solids content of at least 5% by weight.

32. The method according to claim 1, further comprising:

adding an alkaline agent to said pulp slurry or to the formed paper sheet, unless the pulp slurry already originally contains an alkaline agent;

adding the at least one aldehyde functionalized polymer together with a flocculant including an anionic polyacrylamide before or after the paper sheet formation; and adding at least one additional strength additive, such as an anionic polyacrylamide and/or polyamidoamine epichlorohydrin, before or after paper sheet formation.

33. A paper produced by the method according to claim 1.

34. The paper according to claim 33, wherein the wet to dry tensile strength ratio of the paper product is at least 20%.

* * * * *